US006805609B1

(12) United States Patent
Paukert et al.

(10) Patent No.: US 6,805,609 B1
(45) Date of Patent: Oct. 19, 2004

(54) SPRING POWERED CAR WITH LOCKOUT MECHANISM

(75) Inventors: William M. Paukert, Providence, RI (US); Douglas A. Schultheis, Cumberland, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/677,001

(22) Filed: Oct. 1, 2003

(51) Int. Cl.[7] ..... A63H 29/00

(52) U.S. Cl. ..... 446/429; 446/435; 446/457; 446/464

(58) Field of Search ..... 446/228, 229, 446/95, 429, 430, 435, 457, 462, 464, 461

(56) References Cited

U.S. PATENT DOCUMENTS 3,707,805 A 1/1973 Buck ..... 46/202
3,750,328 A * 8/1973 Nielsen et al. ..... 446/429
3,798,832 A * 3/1974 Terzian ..... 446/429
4,087,935 A * 5/1978 Edmisson et al. ..... 446/423
4,511,342 A * 4/1985 Hart et al. ..... 446/429
5,660,575 A * 8/1997 Chuang ..... 446/409

* cited by examiner

*Primary Examiner*—Jacob K. Ackun
*Assistant Examiner*—Bena B. Miller
(74) *Attorney, Agent, or Firm*—Marshall, Gerstein & Borun LLP

(57) ABSTRACT

A toy car comprises a base, a plurality of wheels arranged to support the base for rolling movement over a surface, a spring-powered drive train carried by the base and operatively coupled to at least one of the wheels and having at least one rotatable drive gear, a post shiftably mounted to the base and moveable between a first position and a second position and including a camming surface, and a pawl carried by the base and including a camming surface. The camming surface of the post and the camming surface of the pawl are arranged to shift the pawl into engagement with the teeth of the drive gear in response to movement of the post to the first position, and the pawl is arranged to shift away from the drive gear in response to movement of the post to the second position.

23 Claims, 11 Drawing Sheets

SPRING POWERED CAR WITH LOCKOUT MECHANISM

BACKGROUND OF THE INVENTION

The present invention is directed to a spring powered toy car and, more specifically, to a spring powered toy car having a lockout mechanism that prevents the spring from powering the drive wheels when the lockout mechanism is engaged.

Playsets for toy vehicles, including spring-powered toy vehicles, electrically or battery powered toy vehicles, and unpowered toy vehicles are known in the art. Many of these playsets typically include, for example, one or more track sections with a multitude of turns, loops, hills, crossovers, and/or other obstacles or features designed to enhance the play value of the toy vehicles.

The simplicity of a spring-powered car holds appeal for many users. A fully wound spring-powered car may have enough power to travel a considerable distance and to negotiate a number of turns, loops, and other obstacles. Some spring-powered toy cars are adapted to be wound by a winding device, which fosters more rapid play and reduces the time between runs. However, in some circumstances it may be desirable to prevent the spring in the toy car from inadvertently unwinding prior to the commencement of the next run.

SUMMARY OF THE INVENTION

In one aspect, a spring-powered toy car set comprises a winding device defining a receiving area, a toy car including a base, a drive wheel mounted to the base, and a driving mechanism mounted to the base, with the driving mechanism including a drive spring arranged to drive the drive wheel. The driving mechanism includes a post shiftable between a first position and a second position and post arranged to prevent the drive spring from driving the drive wheel when the post is in the first position. The post is further arranged to permit the drive spring to drive the drive wheel when the post is in the second position, and an adaptor is operatively coupled to the spring and mounted to the base, with the adaptor sized and shaped to engage the winding device when the toy car is placed on the receiving area to permit winding of the drive spring. A portion of the receiving area is arranged to shift the post to the first position in response to placement of the toy car on the receiving area.

A body may be provided which is sized for mounting to the base and which includes an actuator button positioned to contact the post. The actuator button may be spring biased, and the body may be secured to the base by a spring-loaded retaining tab sized to engage a catch on the body.

The driving mechanism may include at least one rotatable gear having a toothed periphery, and a pawl is shiftably mounted to the base adjacent the toothed periphery, with the pawl shiftable between a first position in which the pawl engages the toothed periphery thereby preventing rotation of the rotatable gear and a second position disengaged from the rotatable gear. The pawl is shiftable to the first position in response to shifting of the post to the first position and shiftable to the second position in response to shifting the post to the second position. The pawl may be spring-biased toward the second position, and the post and the pawl preferably include cooperating camming surfaces.

The base may include a lower side having an aperture, with the post protruding from the aperture when the post is in the second position. The base may include an upper side having an aperture, and the post may be sized to extend through the aperture when the post is in the first position.

In another aspect, a toy car comprises a base, a plurality of wheels arranged to support the base for rolling movement over a surface, a drive train including a spring, the drive train mounted to the base and operatively coupled to at least one of the wheels by at least one drive gear, at least a portion of the drive gear surrounded by a set of teeth, a post shiftably mounted to the base and moveable between a first position and a second position, and a pawl shiftably mounted to the base and responsive to movement of the post. The pawl is arranged to prevent rotation of the drive gear when the post is in the first position, the pawl further is arranged to permit rotation of the drive gear when the post is in the second position.

In a further aspect, a toy car comprises a base, a plurality of wheels arranged to support the base for rolling movement over a surface, a spring-powered drive train carried by the base and operatively coupled to at least one of the wheels and having at least one rotatable drive gear, the drive gear including a set of teeth, a post shiftably mounted to the base and moveable between a first position and a second position, the post including a camming surface, and a pawl carried by the base and including a camming surface. The camming surface of the post and the camming surface of the pawl are arranged to shift the pawl into engagement with the teeth of the drive gear in response to movement of the post to the first position, and the pawl is arranged to shift away from the drive gear in response to movement of the post to the second position.

DETAILED DESCRIPTION OF VARIOUS EMBODIMENTS

Figure 1:
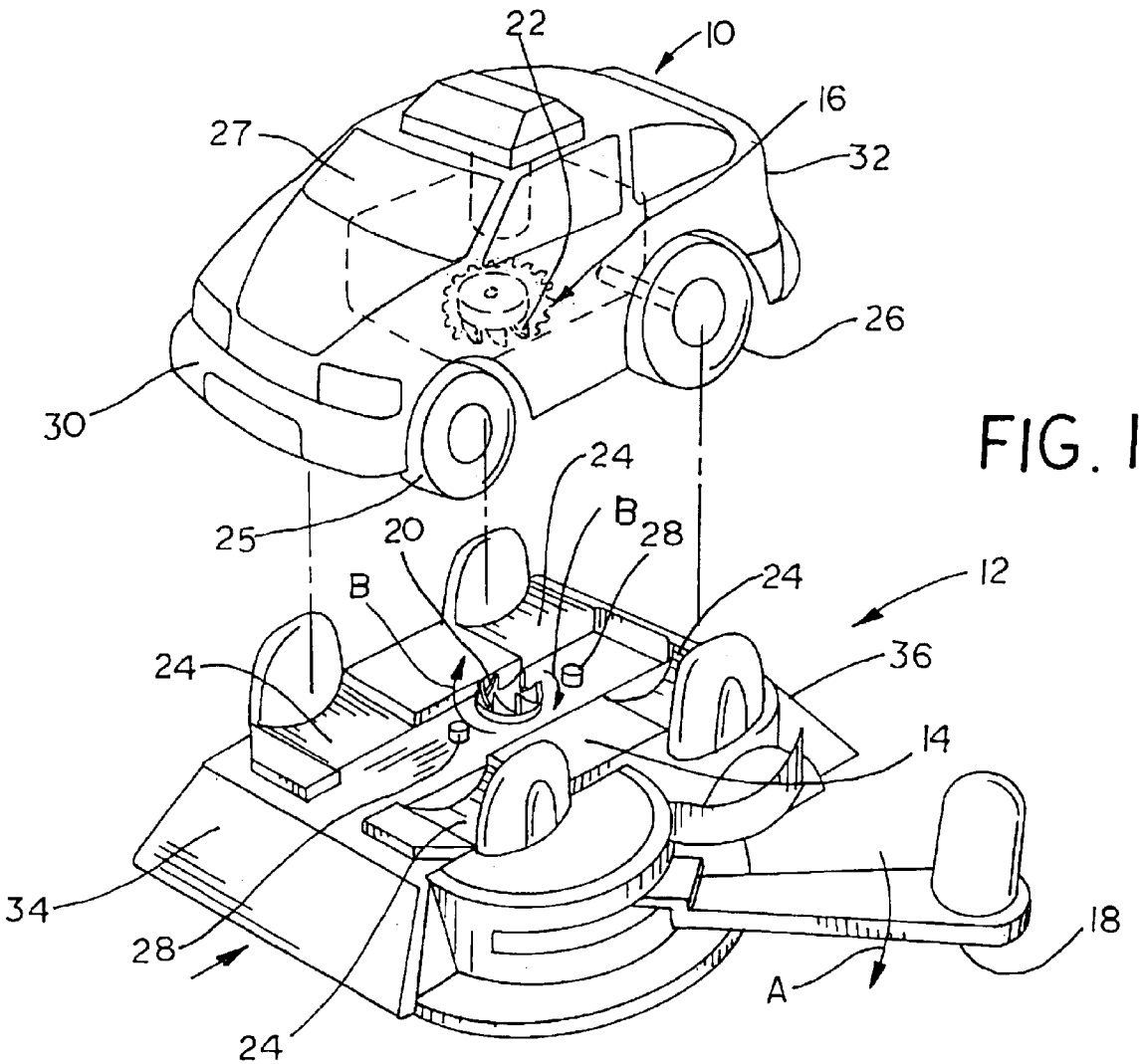
FIG. 1 is a perspective view of a spring-powered toy car assembled in accordance with the teachings of the present invention and shown with a hand-operated winding device.
Figure 2:
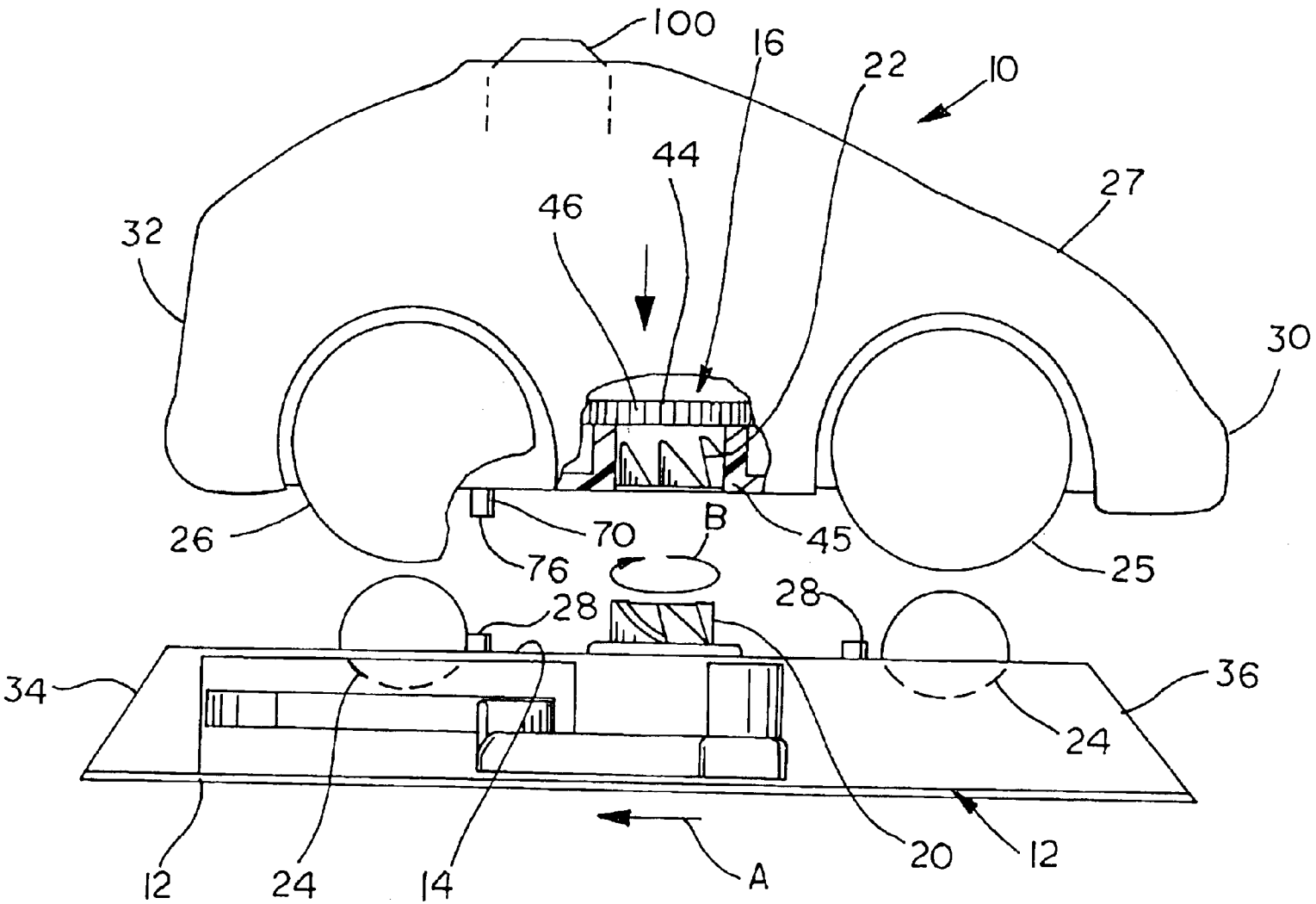
FIG. 2 is an enlarged elevational view, partly in cutaway, illustrating the spring-powered toy car of FIG. 1 being placed on a winding device in preparation for winding the spring.
Figure 3:
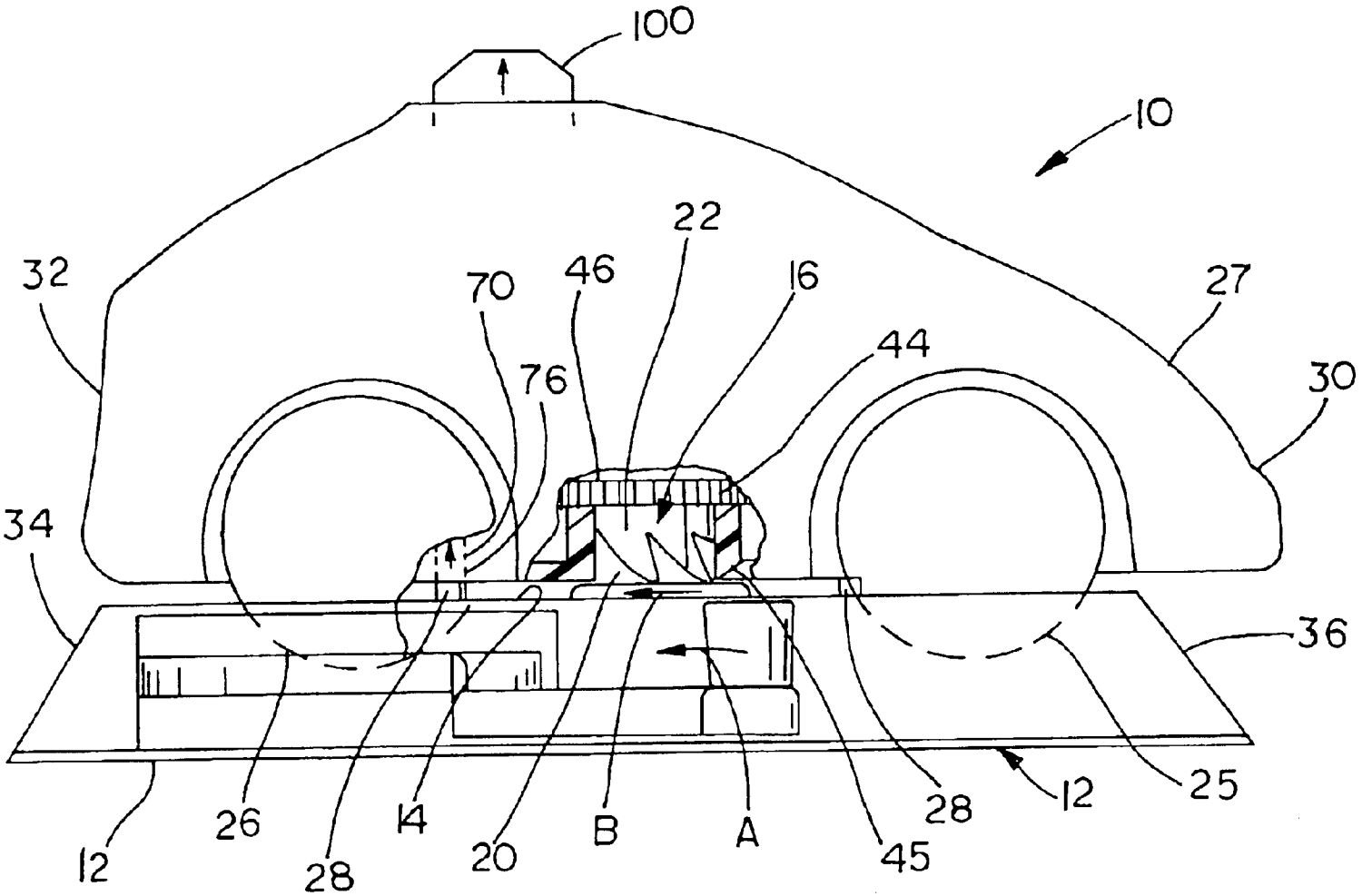
FIG. 3 is an enlarged elevation view similar to FIG. 2 illustrating the spring-powered toy car in place on the winding device.

Referring now to FIGS. 1 through 3 of the drawings, a spring-powered toy car assembled in accordance with the teachings of the disclosed example of the present invention is shown and is generally referred to by the reference 10. Preferably, the toy car 10 is adapted for use, as will be explained in greater detail below, with a winding device 12. An optional launch stand 13 (FIGS. 7 and 8) may also be provided. The winding device 12 includes a receiving area 14, and the toy car 10 includes a spring-powered drive train 16. Accordingly, the toy car 10 can be placed on the receiving area 14 of the winding device 12 to permit winding of the spring-powered drive train 16.

Figure 12:
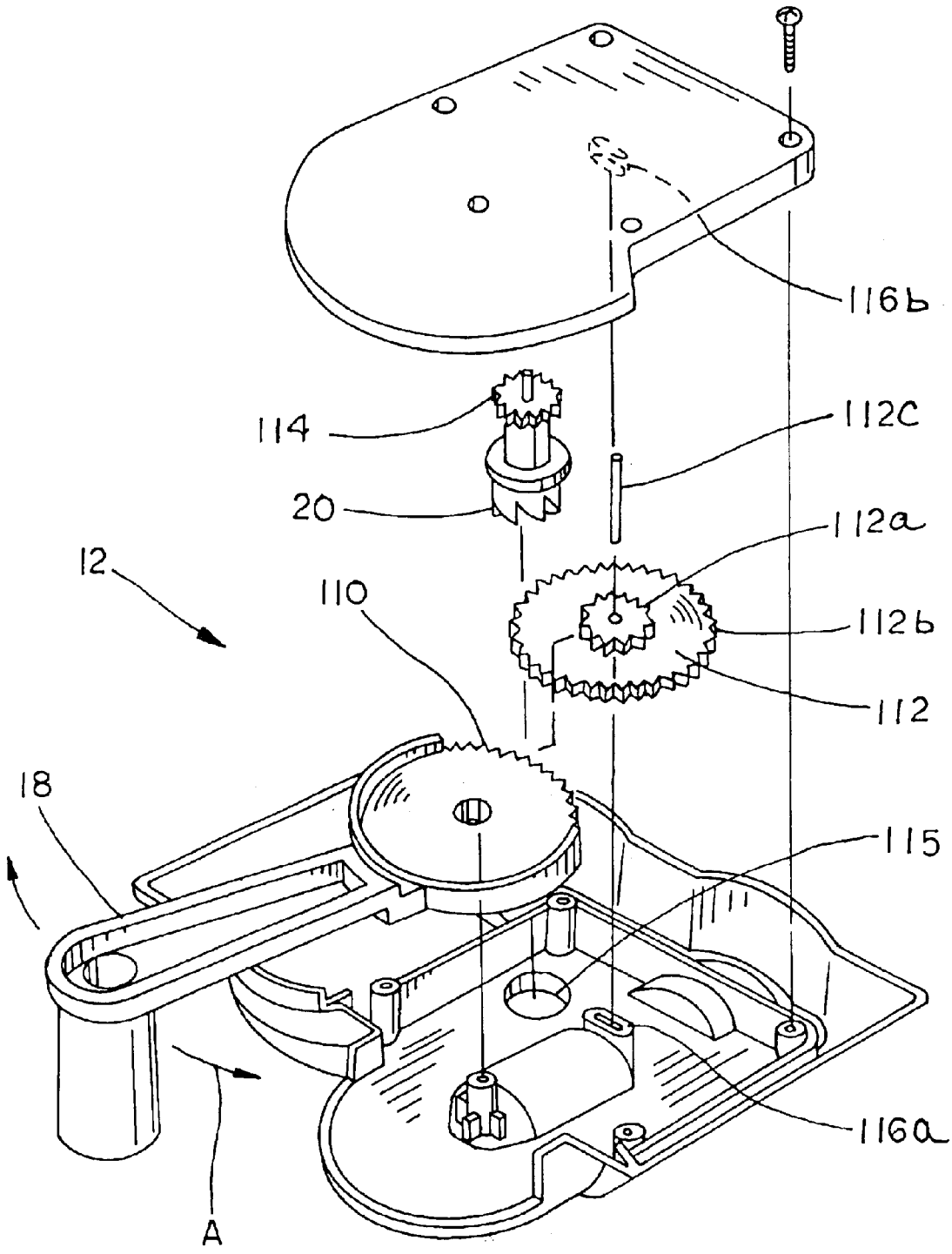
FIG. 12 is an exploded view in perspective of the winding device.

The winding device 12 preferably includes a handle 18 and a toothed winding adaptor or cog 20. The winding cog 20 is preferably located on the receiving area 14 of the winding device 12 such that a corresponding toothed winding adaptor or cog 22 on the toy car 10 will engage the winding cog 20 on the winding device 12. It will be understood that movement of the handle 18 in the direction indicated by the reference arrow A will result in a corresponding rotational movement of the winding cog 20 in the direction B. The mechanism for converting the movement of the handle 18 into rotational movement of the winding cog 20 is shown in FIG. 12 and will be discussed in greater detail below.

The receiving area 14 of the winding device 12 preferably includes a plurality of indentations 24, while the toy car 10 includes a plurality of front wheels 25 and a plurality of rear or drive wheels 26. The toy car 10 also preferably includes a body 27. The indentations 24 are preferably sized and located on the winding device in order to receive a corresponding one of the wheels 25, 26, with the indentations 24 preferably generally symmetrically disposed on the receiving area 14 relative to the winding cog 20, such that the toy car may be placed on the winding device 12 in either direction. The receiving area 14 preferably also is provided with one or more posts 28 and, in the disclosed example, a pair of the posts 28 are preferred. Preferably, the posts 28 are generally symmetrically disposed on the receiving area 14 relative to the winding cog 20. The toy car 10 includes a front end 30 and a rear end 32, while the winding device 12 includes a pair of ends 34 and 36. Accordingly, the toy car 10 may be disposed on the winding device 12 with the front end 30 disposed toward the end 34 and the rear end 32 disposed toward the end 36, or with the front end 30 disposed toward the end 36 and the rear end 32 disposed toward the end 34.

Figure 4:
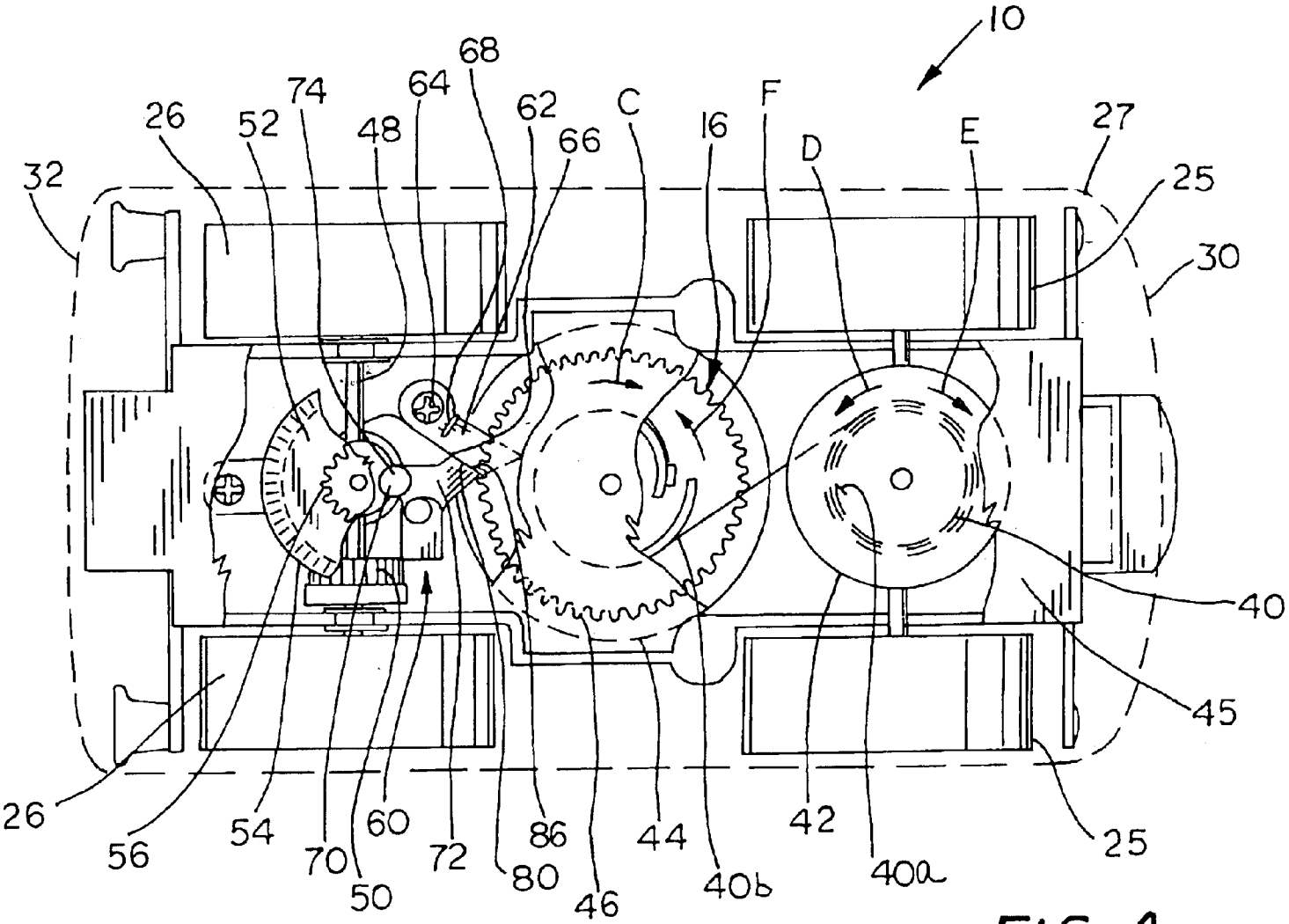
FIG. 4 is an enlarged top plan view, partly in cutaway, illustrating portions of the drive train and showing components of the lockout mechanism in a position in which rotation of the drive gear is prevented.
Figure 5:
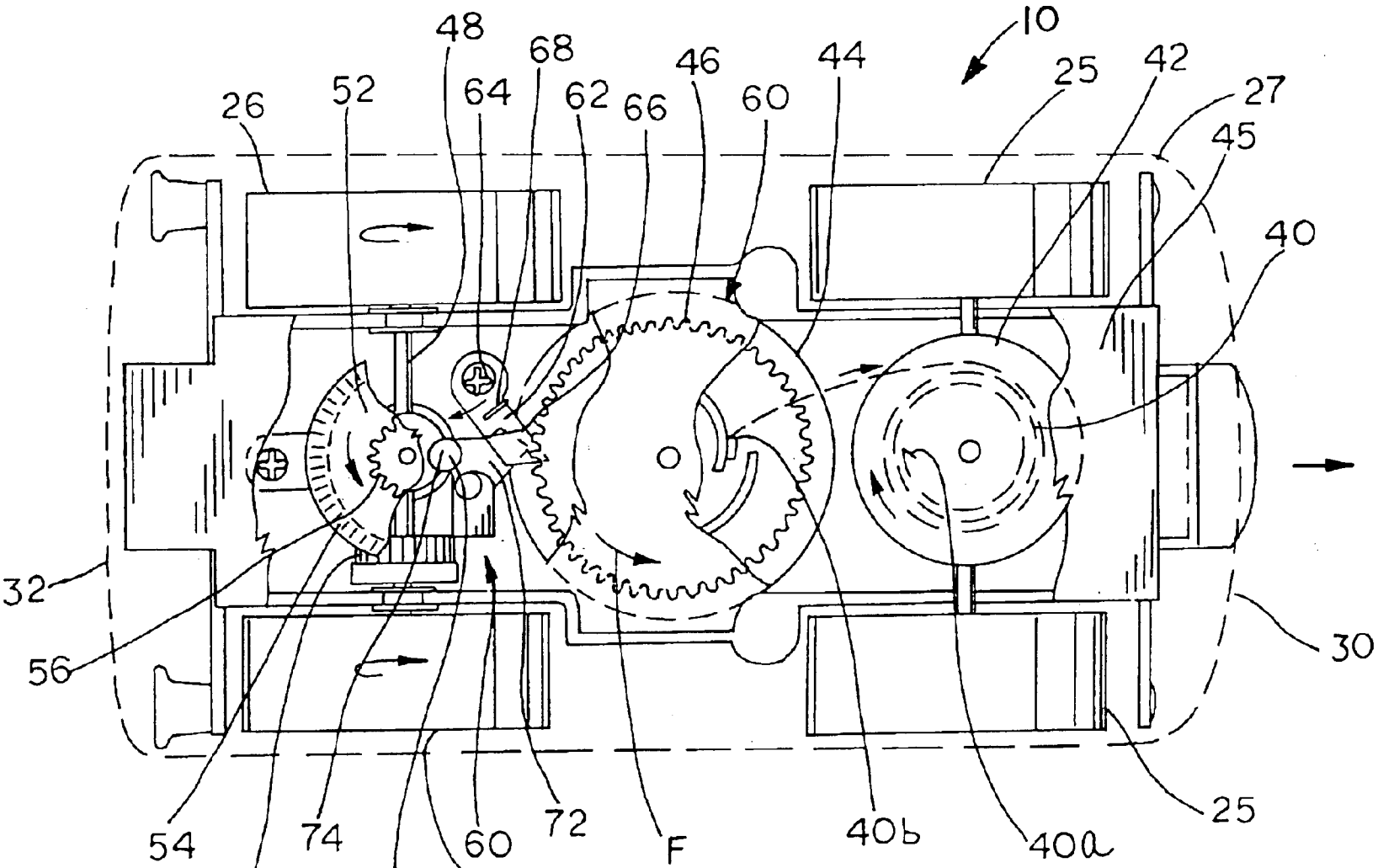
FIG. 5 is an enlarged top plan view similar to FIG. 4 illustrating portions of the drive train and showing components of the lockout mechanism in a position in which rotation of the drive gear is permitted.

Referring now to FIGS. 4 and 5, the spring-powered drive train 16 is coupled to the drive wheels 26. The drive train 16 includes a spring which, in the disclosed example, is a clock wound spring 40. The spring 40 is disposed on and has one end 40*a* anchored to a rotatable spindle 42, and has another end 40*b* anchored to a rotatable spindle 44. The rotatable spindle 44 includes a cog or gear 46, and the spindle 42 and the spindle 44 are both rotatably mounted to a frame or base 45. It will be appreciated that the winding cog 22 is preferably formed on a lower portion of the spindle 44 (FIGS. 2, 3, 7 and 8), such that rotation of the winding cog 22 rotates the spindle 44 and the spindle 42.

Figure 6:
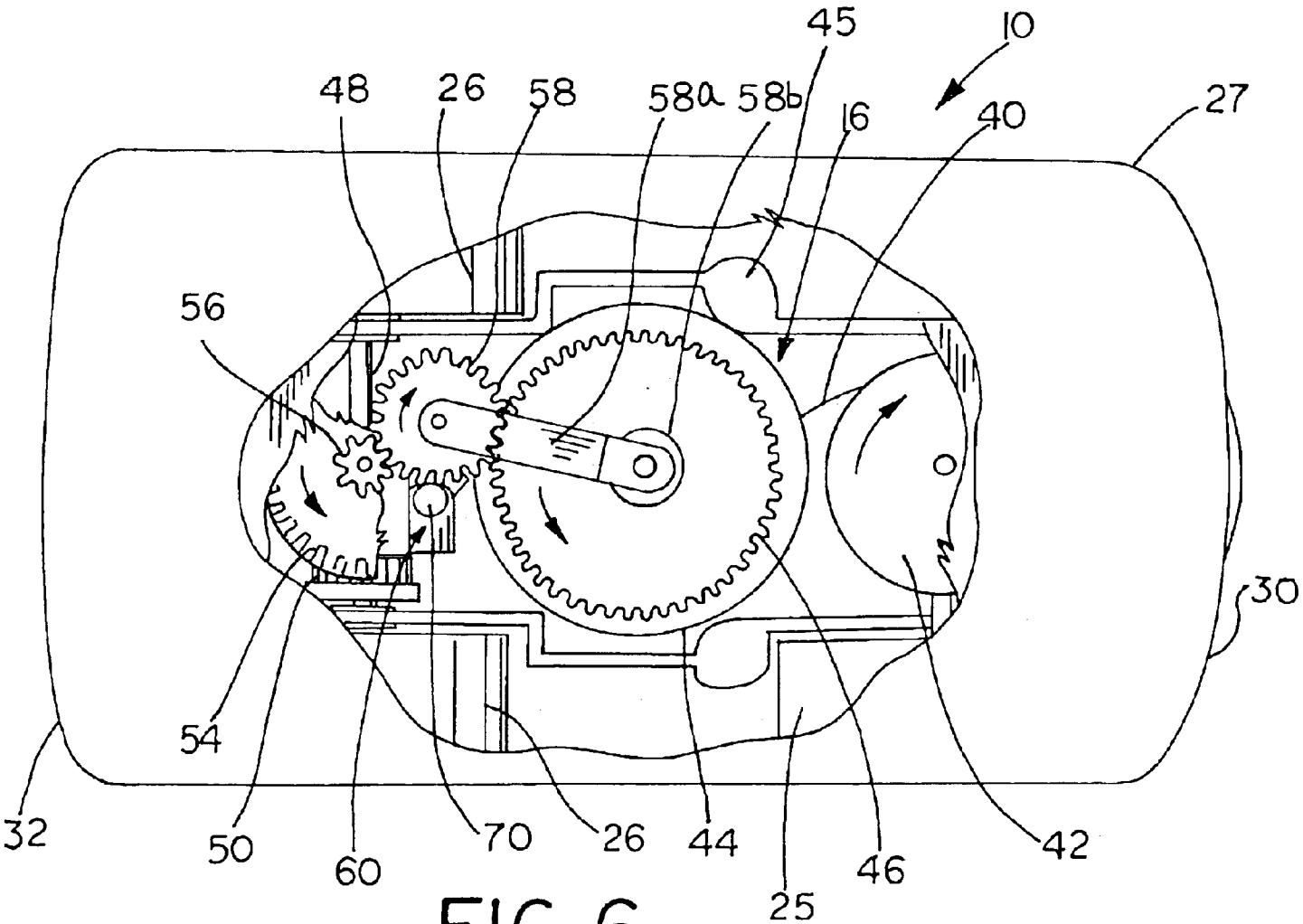
FIG. 6 is an enlarged fragmentary top plan view, partly in cutaway, illustrating the further components of the drive train.

The front wheels 25 and the rear wheels 26 are mounted to the base 45, with the rear wheels 26 including a rotatable drive axle 48. The drive axle 48 includes a cog or gear 50. A gear 52 having an outer cog 54 and in a cog 56 is rotatably mounted to the base 45. The outer cog 54 meshes with the gear 50 on the drive axle 48, while the inner cog 56 engages an idler gear 58 (FIG. 6) rotatably mounted to the base 45. The idler gear 58 in turn engages the cog 46 on the spindle 44 (FIG. 6). Preferably, the idler gear 58 may be mounted to a swing arm 58*a* which is biased counterclockwise when viewing FIG. 6 by a torsion spring 58*b*. The swing arm 58*a* does not rotate with the spindle 44. Accordingly, rotation of the spindle 44 will be transmitted via the idler gear 58 to the gear 52 via the inner cog 56. In response to rotation of the gear 52, the drive axle 48 and hence the drive wheels 26 are rotated due to the meshing engagement between the outer cog 54 of the gear 52 and the gear 50 mounted on the drive axle 48.

It will be appreciated that the spindle 44 is rotated in the generally clockwise direction indicated by the reference arrow C in response to rotation of the winding cog 22. Because the end 40*b* of the spring 40 is connected to the spindle 44, a portion of the spring 40 will be wound on to the spindle 44, thus causing the spindle 42 to rotate in the generally counterclockwise direction indicated by the reference arrow D. As will be apparent to those of skill in the art, the clock wound coil spring 40 will, in response to winding the spring onto the spindle 44 as described above, apply a resisting force to the spindle 42 in the generally clockwise direction indicated by the reference arrow E.

The toy car 10 includes a lockout mechanism 60. In the disclosed example, the lockout mechanism 60 includes a pawl 62 mounted to the base 45 by a pivot 64. The pawl 62 includes a tooth 66 which is sized to engage the cog 46 on the spindle 44. A torsion spring 68 is mounted to the base 45 and engages the pawl 62, thereby biasing the pawl 62 in a generally clockwise direction relative to the pivot 64. It will be appreciated that, in the disclosed example, when the pawl 62 is biased in the clockwise direction about the pivot 64 that the tooth 66 is urged away from the cog 46 on the spindle 44.

Figure 10:
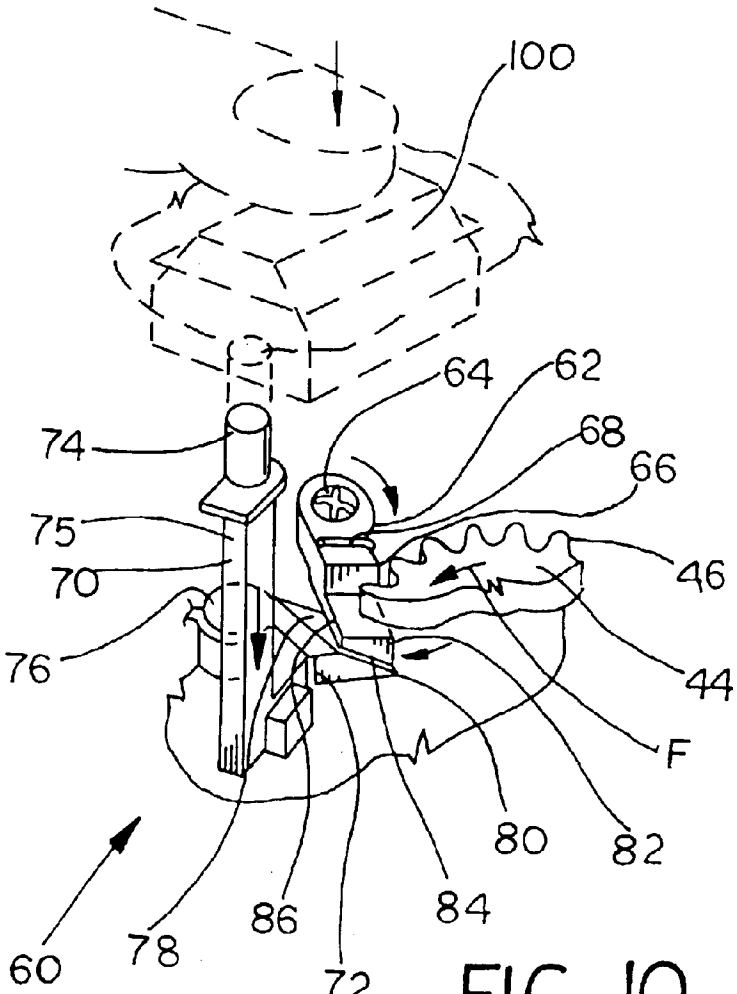
FIG. 10 is an enlarged fragmentary view in perspective similar to FIG. 9 illustrating portions of the lockout mechanism disposed in a position in which rotation of the drive gear is permitted.
Figure 11:
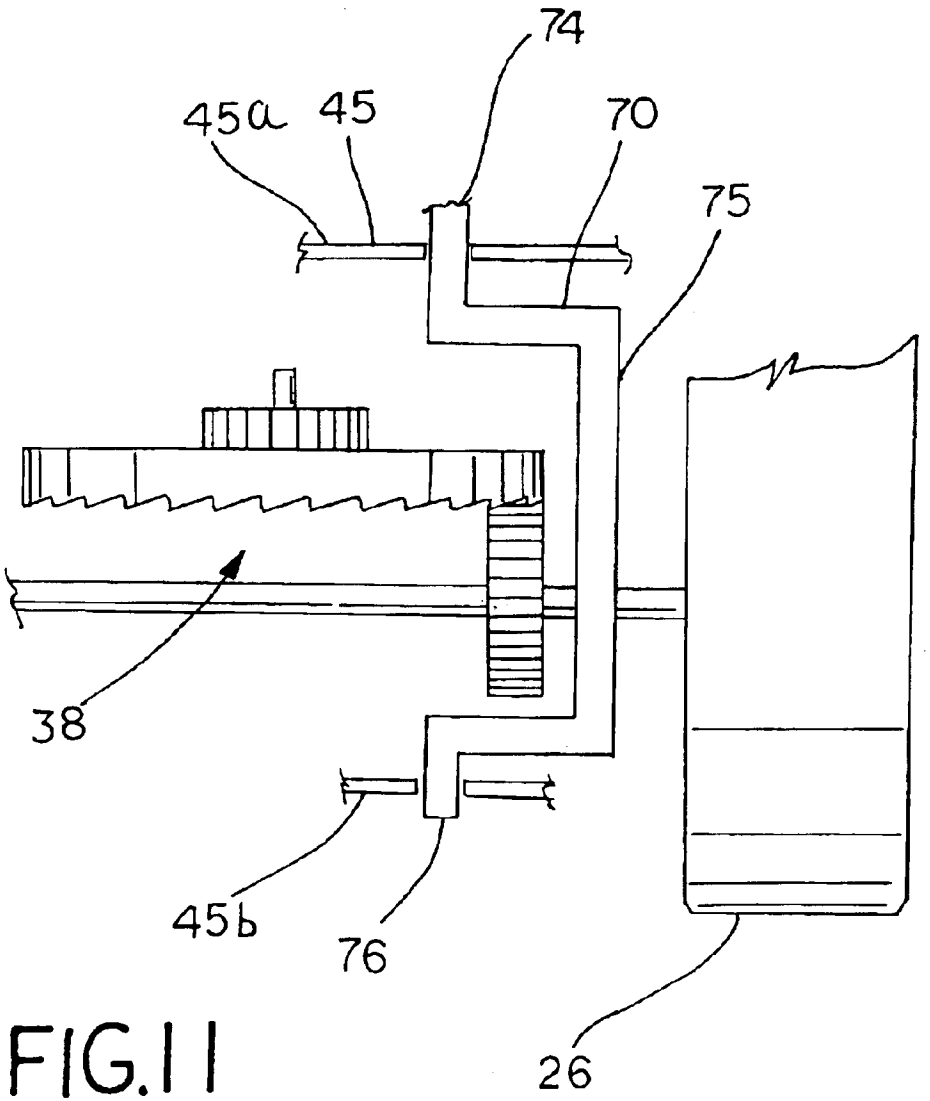
FIG. 11 is an enlarged fragmentary elevational view illustrating the offset central portion of the shiftable post.

The lockout mechanism 60 also includes a vertically shiftable post 70 having a laterally extending cam plate 72. As can be seen in FIGS. 4 and 5, the cam plate 72 is sized to engage the pawl 62. More specifically, and referring now to FIGS. 9 and 10, the post 72 includes an upper end 74, a middle portion 75, and a lower end 76. As is shown in FIG. 11, the middle portion 75 may be offset laterally relative to the upper end 74 and the lower end 76, such that the post 70 will be shiftable up and down without interference with portions of the drive train 16.

Referring again to FIGS. 9 and 10, the cam plate 72 extends laterally from the lower end 76 and includes an angled camming surface 78. The cam plate 72 terminates in an edge 80. The pawl 62 includes a lower portion 82 which is sized to extend, in the disclosed example, beneath the cog 46 of the spindle 44. The lower portion 82 includes an angled camming surface 84 and an edge 86. The post 70 is shiftable between a raised position as is shown and FIG. 9, and a lowered position as is shown in FIG. 10. It will be appreciated that, in the disclosed example, when the post 70 is shifted toward the raised position, the camming surface 78 will engage the camming surface 84, thereby rotating the pawl 62 in a generally counterclockwise direction, such that the tooth 66 is brought into engagement with the cog 46. Thus, when the tooth 66 of the pawl 62 is in engagement with the cog 46, rotation of the spindle 44 in the counterclockwise direction indicated by the reference arrow F is prevented.

Figure 8:
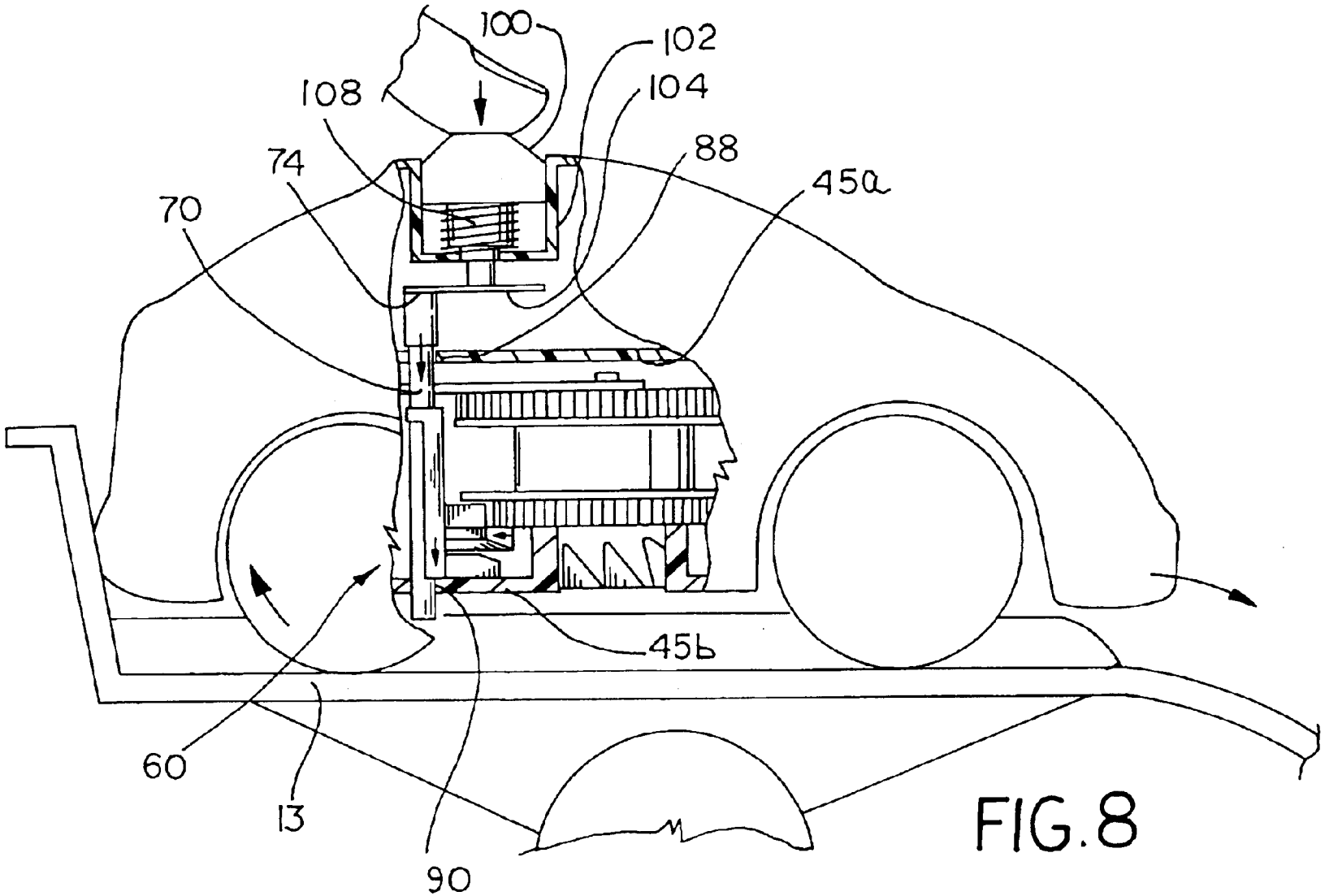
FIG. 8 is an enlarged elevational view similar to FIG. 7 illustrating components of the lockout mechanism in a position in which rotation of the drive gear is permitted.
Figure 9:
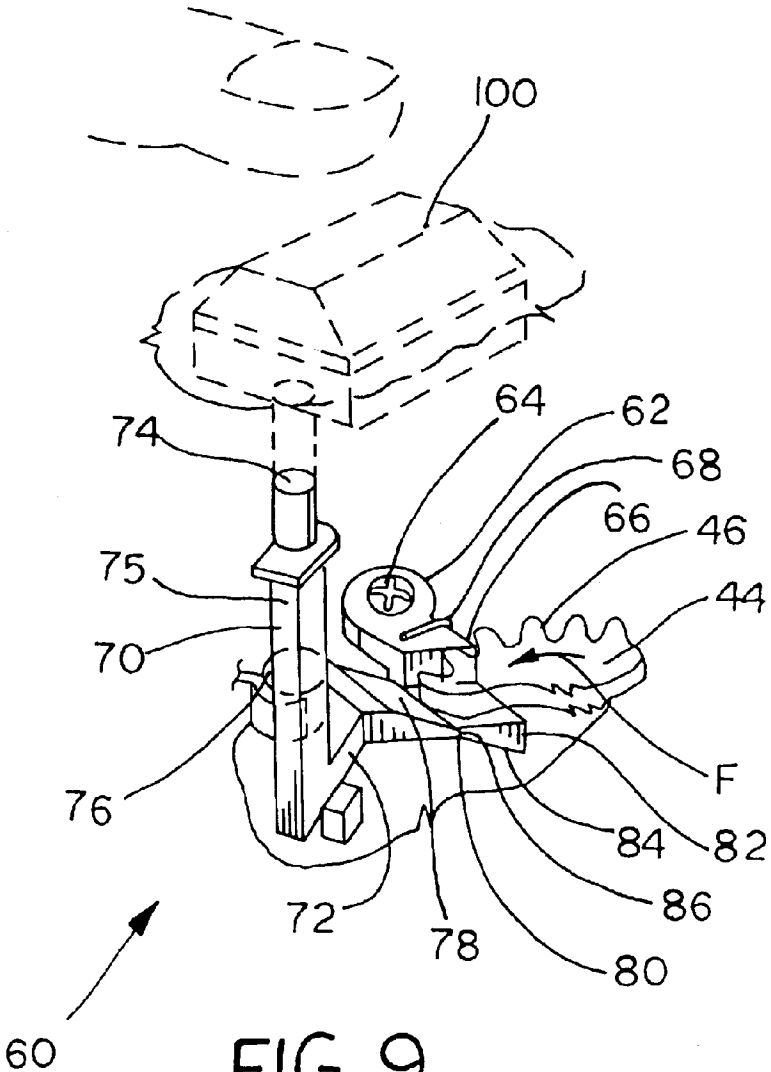
FIG. 9 is an enlarged fragmentary view in perspective illustrating portions of the lockout mechanism disposed in a position in which rotation of the drive gear is prevented.

Also, it will be noted that when the post 70 is in the raised position shown and FIG. 9, the edge 86 of the pawl 62 is in abutting engagement with the edge 80 of the post 70, such that counterclockwise rotation of the pawl 62 about the pivot 64 is prevented. When the post 70 is lowered, such as is shown in FIG. 10, will the edge 80 is shifted beneath the edge 86, he end the pawl 62 is free to rotate in a generally clockwise direction about the pivot 64 as the camming surface 84 slides over the camming surface 78. Rotation of the pawl 62 in the clockwise direction is aided by the torsion spring 68. As the pawl 62 rotates in the clockwise direction, the tooth 66 is moved out of engagement with the cog 46, and thus the spindle 44 is free to rotate in the counterclockwise direction F as shown in FIG. 10 (also visible in FIGS. 4 and 5). As can be seen from FIGS. 9 and 10, the upper and lower ends 74, 76 are preferably round, so as to fit into corresponding guide apertures 88, 90, respectively (visible in FIGS. 7 and 8).

Figure 7:
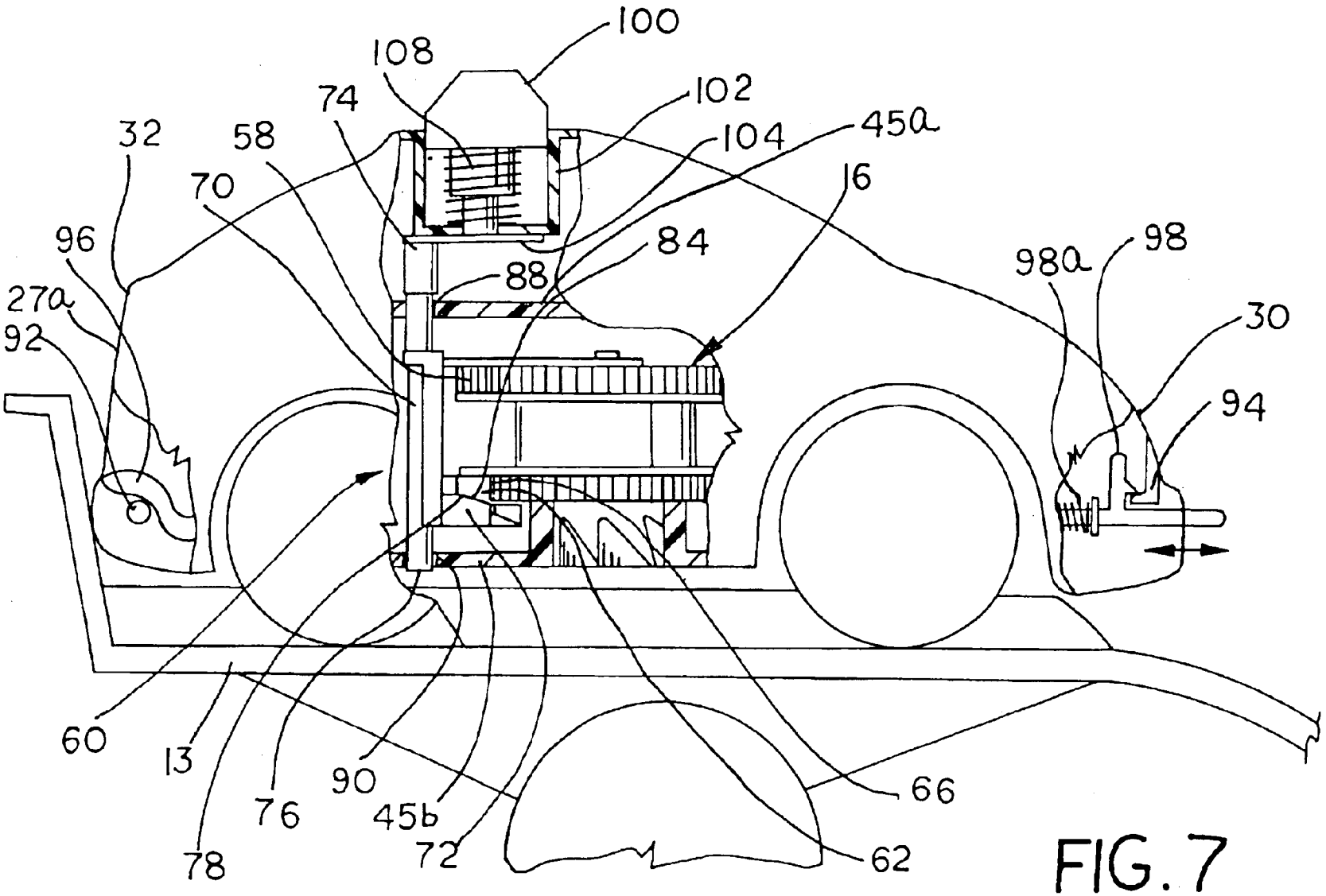
FIG. 7 is an enlarged elevational view, partly in cutaway, illustrating components of the lockout mechanism in a position in which rotation of the drive gear is prevented.

Referring to FIGS. 7 and 8, the guide apertures 88 and 90 are preferably defined in an upper portion 45*a* and a lower portion 45*b*, respectively, of the base 45. And shown in FIG. 7, the body 45 preferably includes a pin 92 disposed adjacent a rear end 27*a* of the body 27, and a catch 94 is disposed adjacent a front end 27*b* of the body 27. Still preferably, the base 45 includes a notch 96 sized to receive the pin 92, and also includes shiftable retaining tab 98 having a spring 98*a*. The retaining tab 98 is sized and positioned on the base 45 to releasably engage the catch 94 on the body 27. The retaining tab 98 is shiftable against the force of the spring 98*a*, thereby permitting the body 27 to be released from the base 45 by depressing the retaining tab 98. With the retaining tab 98 released from the catch 94, the body 27 may be pivoted about the pin 92 until the pin 92 can be manipulated out of the notch 96, such that the body 27 may be completely removed from the base 45.

An actuator button 100 is mounted within a housing 102 formed in the body 27. A lower part 104 of the button 100 extends through a lower part 106 of the housing 102 and is positioned to make contact with the upper end 74 of the post 70. A spring 108 is disposed within the housing 102 and is positioned to bias the actuator button 100 upwardly. As will be explained in greater detail below, when a user desires to shift the lockout mechanism 60 from the position of FIG. 7, in which operation of the drive train 16 is prevented, toward the position of FIG. 8, in which operation of the drive train 16 is permitted, the user depresses the actuator button 100.

Referring now to FIG. 12, the winding device 12 is shown in exploded and inverted form. The winding device 12 includes a gear 110 attached to the handle 18, a gear 112 having an inner cog 112*a* and an outer cog 112*b*, and a gear 114 connected to the winding cog 20. The handle 18 and the gears 112 and 114 are rotationally mounted within the winding device 12, and the winding cog 20 protrudes from a suitably shaped aperture 115. The gear 112 is mounted to the winding device 12 by a pin 112*c*, with the pin 112*c* engaging a pair of slots 116*a* and 116*b*, with the slot 116*b* shown formed in a removable cover. The gear 110 of the handle 18 engages the inner cog 112*a*, while the outer cog 112*b* engages the gear 114. Because the gear 112 is mounted within the slots 116*a* and 116*b* by the pin 112*c*, when the handle 18 is moved in the direction A, the entire gear 112 is urged toward the gear 114, with the ends of the pin 112*c* traveling along the slots 116*a* and 116*b*. Thus, the gear 112*b* will move into a position to engage the gear 114 on the winding cog 20, thus rotating the winding cog 20. On the other hand, when the handle 18 is moved in the opposite direction, the gear 112 is free to shift away from the gear 114, with the pin 112*c* again guided by the slots 116*a* and 166*b*, thus acting like a throw-out mechanism as the gear 112 moves out of contact with the gear 114. Accordingly, the winding cog 20 will only rotate in the desired direction. Thus, back and forth motion of the handle 18 will be converted into desired rotation of the winding cog 20. The winding cog 20 may include a spring 118.

In operation, when it is desired to use the toy car 10, the user places the toy car 10 on the receiving area 14 of the winding device 12. As discussed above, the toy car 10 may be oriented on the receiving area 14 of the winding device 12 in at least two different directions. Preferably, the wheels 25, 26 will be received in the indentations 24. As the toy car 10 is placed on the winding device 12 in the chosen orientation, the lower end 76 of the post 70 will be brought into contact with one of the posts 28 defined on the receiving area 14. As is shown in FIG. 2, it may often be the case that, when it is desired to wind the spring 40 of the drive train 16, the post 70 may be disposed in a lowered or downward position as shown. It will be understood that when the post 70 is in the downward position shown, the lockout mechanism 60 is disengaged and the drive train 16 will, if the spring 40 has been wound, direct driving force to the rear wheels 26 of the toy car 10.

Referring now to FIG. 3, when the toy car 10 is disposed on the receiving area 14 of the winding device 12 as shown, the post 70 is automatically shifted upwardly toward a raised position by virtue of contact between the lower end 76 of the post 70 and a corresponding one of the posts 28 on the receiving area 14. Also, the winding cog 22 is brought into meshing engagement with the winding cog 20. By manipulating the handle 18 of the winding device 12 as described above, the spring 40 may be wound as rotational movement of the winding cog 20 is transmitted to the winding cog 22 thus rotating the spindle 44. It will be appreciated that, when the post 70 is shifted upwardly, the lockout mechanism 60 will be shifted to the position shown in FIG. 9, such that unwinding of the spring is prevented.

Referring now to FIG. 4, as the spring 40 is wound the spindle 44 is rotated in the clockwise direction C. The pawl 62 is free to rotate in a generally counterclockwise direction against the force of the spring 68 about the pivot 64 as the tooth 66 ratchets freely against the rotating cog 46 of the spindle 44. As the spindle 44 is rotated in the clockwise direction C, a portion of the clock spring 40 is wound onto the spindle 44 as the spindle 42 rotates in the counterclockwise direction D. When the winding operation is finished, the tooth 66 of the pawl 62 is in locking engagement with the cog 46 of the spindle 44, and counterclockwise rotation of the spindle 44 is prevented due to contact between the edges 80 and 86. Because the lockout mechanism 60 is engaged and operation of the drive train 16 is prevented, inadvertent unwinding of the drive spring 40 is prevented.

When the user desires to operate the drive train 16, releasing the force of the wound drive spring 40, the user depresses the actuator button 100 as shown in FIGS. 8 and 10. Downward movement of the actuator button 100 forces the post 70 downwardly, which moves the edge 80 of the post 70 downwardly and out of abutting contact with the edge 86 of the pawl 62. Due to the force of the spring 40, the spindle 42 is now free to rotate in the clockwise direction E, causing a corresponding counterclockwise rotation of the spindle 44. Because the cam plate 72 has been lowered to the lowering of the post 70, the lockout mechanism 60 is now disabled, as the cam plate 72 now permits clockwise rotation of the pawl 62 about the pivot 64. The pawl 62 no longer interferes with counterclockwise rotation of the spindle 44, and all of the driving force of the spring 40 is now transmitted via the drive train 16 to the drive wheels 26. The entire operation may of course be repeated.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A spring-powered toy car set comprising:

a winding device defining a receiving area;

a toy car including a base, a drive wheel mounted to the base, and a driving mechanism mounted to the base, the driving mechanism including a drive spring arranged to drive the drive wheel, the driving mechanism including a post, the post shiftable between a first position and a second position, the post arranged to prevent the drive spring from driving the drive wheel when the post is in the first position, the post further arranged to permit the drive spring to drive the drive wheel when the post is in the second position;

an adaptor operatively coupled to the spring and mounted to the base, the adaptor sized and shaped to engage the winding device when the toy car is placed on the receiving area to permit winding of the drive spring; and a portion of the receiving area arranged to shift the post to the first position in response to placement of the toy car on the receiving area.

2. The device of claim 1, including a body sized for mounting to the base, the body including an actuator button positioned to contact the post.

3. The device of claim 2, wherein the actuator button is spring biased.

4. The device of claim 2, wherein the base includes a spring-loaded retaining tab and wherein the body includes a catch adapted to engage the retaining tab.

5. The device of claim 1, wherein the driving mechanism includes at least one rotatable gear having a toothed periphery, and including a pawl shiftably mounted to the base adjacent the toothed periphery, the pawl shiftable between a first position in which the pawl engages the toothed periphery thereby preventing rotation of the rotatable gear and a second position disengaged from the rotatable gear, the pawl shiftable to the first position in response to shifting of the post to the first position and shiftable to the second position in response to shifting the post to the second position.

6. The device of claim 5, wherein the pawl is spring-biased toward the second position.

7. The device of claim 5, wherein the post and the pawl include cooperating camming surfaces.

8. The device of claim 1, wherein the base includes a lower side having an aperture, the post protruding from the aperture when the post is in the second position.

9. The device of claim 1, wherein the base includes an upper side having an aperture, the post sized to extend through the aperture.

10. The device of claim 1, wherein the base includes an upper side and a lower side, the post sized to extend through the aperture in the lower side when the post is in the first position, the post sized to extend through the aperture in the upper side when the post is in the second position.

11. A toy car comprising:

a base;

a plurality of wheels arranged to support the base for rolling movement over a surface;

a drive train including a spring, the drive train mounted to the base and operatively coupled to at least one of the wheels by at least one drive gear, at least a portion of the drive gear surrounded by a set of teeth;

a post shiftably mounted to the base and moveable between a first position and a second position; and a pawl shiftably mounted to the base and responsive to movement of the post, the pawl arranged to prevent rotation of the drive gear when the post is in the first position, the pawl further arranged to permit rotation of the drive gear when the post is in the second position.

12. The device of claim 11, including a body sized for mounting to the base, the body including a shiftable actuator button arranged to shift the post from the first position to the second position.

13. The device of claims 12, wherein the actuator button is disposed in an aperture formed in the body.

14. The device of claim 13, including a surface disposed adjacent the aperture, and wherein the actuator button is spring-biased away from the surface.

15. The device of claim 12, in combination with a winding device having a winding gear and defining a receiving area, and wherein the toy car includes an adaptor mounted to the base and operatively coupled to the spring, the adaptor sized and shaped to engage the winding gear when the toy car is placed on the receiving area to permit winding of the drive spring.

16. The device of claim 15, wherein the receiving area includes a protrusion, and wherein the post is disposed on the base to be shiftable to the first position in response to placement of the toy car on the receiving area.

17. The device of claim 16, wherein the receiving area includes a pair of protrusions, and wherein the post is located on the base so as to contact a selected one of the protrusions in response to placement of the toy car on the receiving area in either a first orientation or a second orientation.

18. The device of claim 11, wherein the pawl is pivotally mounted to the base and is spring-biased away from the drive gear.

19. The device of claim 18, wherein the post and the pawl include cooperating camming surfaces, and wherein the camming surfaces cooperate to shift the pawl toward the drive gear in response to movement of the post to the first position.

20. The device of claim 19, wherein the base includes an upper side and a lower side, each of the upper and lower sides having an aperture, the post extending through the aperture in the upper side when the post is in the first position, the post extending through the aperture in the lower side when the post is in the second position.

21. A toy car comprising:

a base;

a plurality of wheels arranged to support the base for rolling movement over a surface;

a spring-powered drive train carried by the base and operatively coupled to at least one of the wheels and having at least one rotatable drive gear, the drive gear including a set of teeth;

a post shifably mounted to the base and moveable between a first position and a second position, the post including a camming surface; and a pawl carried by the base and including a camming surface, the camming surface of the post and the camming surface of the pawl arranged to shift the pawl into engagement with the teeth of the drive gear in response to movement of the post to the first position, the pawl arranged to shift away from the drive gear in response to movement of the post to the second position.

22. The device of claim 21, including a body sized for mounting to the base, the body including a shiftable actuator button arranged to shift the post from the first position to the second position.

23. The device of claim 22, including a winding device having a winding gear and defining a receiving area, and wherein the toy car includes an adaptor mounted to the base and operatively coupled to the spring-powered drive train, the adaptor sized and shaped to engage the winding gear when the toy car is placed on the receiving area to permit winding of the spring-powered drive train, and wherein the receiving area includes a protrusion, the post disposed on the base such that a lower end of the post contacts the protrusion in response to placement of the toy car on the receiving area thereby shifting the post to the first position.

* * * * *